US012760930B2

(12) United States Patent
Demmel

(10) Patent No.: US 12,760,930 B2
(45) Date of Patent: Oct. 13, 2026

(54) DEVICE FOR HEATING A LIQUID

(71) Applicant: TRUMA GERAETETECHNIK GMBH & CO. KG, Putzbrunn (DE)

(72) Inventor: Robert Demmel, Putzbrunn (DE)

(73) Assignee: Truma Geraetetechnik Gmbh & Co. KG, Putzbrunn (DE)

( * ) Notice: Subject to any disclaimer, the term of this patent is extended or adjusted under 35 U.S.C. 154(b) by 365 days.

(21) Appl. No.: 18/689,280

(22) PCT Filed: Oct. 17, 2022

(86) PCT No.: PCT/EP2022/000095

§ 371 (c)(1),
(2) Date: Mar. 5, 2024

(87) PCT Pub. No.: WO2023/099021

PCT Pub. Date: Jun. 8, 2023

(65) Prior Publication Data

US 2025/0129968 A1 Apr. 24, 2025

(30) Foreign Application Priority Data

Nov. 30, 2021 (DE) ..... 10 2021 005 935.2

(51) Int. Cl.
*F24H 1/18* (2022.01)
*F24H 9/00* (2022.01)
*F24H 9/13* (2022.01)

(52) U.S. Cl.
CPC ..... *F24H 1/181* (2013.01); *F24H 9/0015* (2013.01); *F24H 9/133* (2022.01)

(58) Field of Classification Search
CPC ..... F28D 20/0039; F28D 2020/0069; F24H 9/0015; F24H 1/186; F24H 9/133; F24H 1/181
See application file for complete search history.

(56) References Cited

U.S. PATENT DOCUMENTS

| | | | | |
|---|---|---|---|---|
| 4,510,922 | A | 4/1985 | Roussos et al. | |
| 7,570,877 | B1 | 8/2009 | Huang | |
| 12,117,245 | B2 * | 10/2024 | Armstrong | F24D 17/02 |
| 2016/0195339 | A1 * | 7/2016 | Simon | F28D 20/0039 165/104.19 |

FOREIGN PATENT DOCUMENTS

| | | | | |
|---|---|---|---|---|
| AT | 391552 | B * | 10/1990 | F24H 9/133 |
| AT | 510578 | B1 * | 5/2012 | F28D 20/0039 |
| CH | 709855 | A2 * | 1/2016 | F28D 20/0039 |
| CN | 107110621 | B * | 9/2019 | F28F 9/026 |
| DE | 4135453 | A1 * | 4/1993 | F28D 20/0039 |
| DE | 202006018615 | U1 | 2/2007 | |
| DE | 19752813 | B4 * | 3/2008 | F28D 20/0039 |
| DE | 202012100431 | U1 | 3/2012 | |
| DE | 202018101720 | U1 * | 6/2018 | F28D 20/0039 |
| EP | 1637816 | A1 | 3/2006 | |
| WO | WO-0063624 | A1 * | 10/2000 | F28D 20/0039 |
| WO | WO-2022122178 | A1 * | 6/2022 | F24H 3/065 |

* cited by examiner

*Primary Examiner* — Gregory A Wilson
(74) *Attorney, Agent, or Firm* — McNees Wallace & Nurick LLC

(57) ABSTRACT

Example embodiments relate to a device for heating a liquid. A heat exchanger device transfers thermal energy generated by an energy unit to the liquid. The liquid flows into an interior space of an internal distributor via an introducing device, and from there into the interior space of a tank.

6 Claims, 2 Drawing Sheets

DEVICE FOR HEATING A LIQUID

FIELD OF DISCLOSURE

The present disclosure relates to a device for heating a liquid. The liquid is for example service water.

BACKGROUND

In the prior art, it is known to produce thermal energy by the combustion of, for example, propane, butane or diesel fuel converted into the gaseous state, and to transfer it to a liquid, for example service water, via a heat exchanger. It is also known that such devices additionally serve as air heating systems.

If the warmed or heated liquid is introduced into a tank, for example to operate in the manner of a boiler, a layering of the liquid is to be observed. The layers relate to different temperatures of the liquid in the tank. This is also relevant to the withdrawal of the liquid from the tank. The object is to prevent the different temperature layers from mixing, if possible.

Distributing structures for liquid tanks are disclosed in documents DE 20 2006 018 615 U1, DE 20 2012 100 431 U1 or DE 20 2018 101 720 U1, for example.

The object on which the present disclosure is based is to propose a device for heating a liquid which is characterized by the best possible layering of the liquid in a tank.

SUMMARY

The present disclosure achieves the object by a device for heating a liquid, comprising an energy unit, a heat exchanger device, and a tank, wherein the energy unit generates thermal energy, wherein the heat exchanger device transfers the thermal energy generated by the energy unit to the liquid, wherein the tank takes up the liquid, wherein the tank has at least one medium inlet and one medium outlet, wherein at least one introducing device and one internal distributor are present in the tank, wherein the introducing device introduces liquid entering the tank via the medium inlet into an interior space of the tank, and wherein the introducing device and the internal distributor are configured and arranged relative to each other such that liquid flows from the introducing device into an interior space of the internal distributor, and from the interior space of the internal distributor into the interior space of the tank.

The present disclosure achieves the object by a device for heating a liquid which includes an energy unit, a heat exchanger device, and a tank. The energy unit generates—for example by the combustion of a fuel-air mixture or by an electrical current—thermal energy which is transferred to the liquid by the heat exchanger device. In one example embodiment, the thermal energy is for example also transferred to room air. The tank takes up the liquid. It is preferably heated liquid, which thus in particular passes through the heat exchanger device and thus has taken up thermal energy. In one example embodiment, the tank also takes up cold liquid and/or a liquid to be heated. In one variant, the liquid is thus for example conveyed from the tank to the heat exchanger device to be heated there. In a further example embodiment, the tank also takes up air which is used to remove liquid from an area in which it could be heated by the heat exchanger device. This is realized, for example, before only room air is to be heated by the device in an air mode.

The tank includes at least one medium inlet and one medium outlet for taking up or discharging the liquid. The liquid is guided from the medium inlet further into the tank by the introducing device. The liquid then first flows from the introducing device into the internal distributor which is also located in the tank, and only from there into the interior space of the tank itself. The liquid is thus purposefully guided to an area in the interior space of the tank with an intermediate step (i.e. the internal distributor).

The liquid flows from the introducing device into the internal distributor and then from the internal distributor into the interior space of the tank itself. As the internal distributor is located in the interior space of the tank, the liquid is first indirectly in the interior space of the tank. When the liquid leaves the interior space of the internal distributor, it is then directly in the interior space of the tank. The liquid thus first flows into a partial space of the interior space of the tank. The internal distributor can thus be referred to as a pre-mixer or as a premixing pot in one design of its geometry. How much liquid flows into the internal distributor and how much flows directly into the interior space of the tank depends, among other things, from the filling level of the liquid in the tank and also from the pressure with which the liquid is guided through the introducing device.

The interior space of the internal distributor is smaller than the interior space of the tank. Therefore, the newly added liquid only comes into contact with a smaller amount of liquid which is possibly already present in the internal distributor. During operation of the device, the temperature difference between the new and the already present liquid in the internal distributor is thus smaller than a temperature difference between new heated liquid and the liquid in the interior space of the tank.

One example embodiment consists in that the heat exchanger device has a liquid inlet for liquid to be heated and a liquid outlet for heated liquid, and in that the medium inlet of the tank and the liquid outlet of the heat exchanger device are connected to each other. In this example embodiment, the tank is arranged downstream of the heat exchanger device and receives the heated liquid therefrom. In one example embodiment, the heat exchanger device includes a proper heat exchanger into which flue gas, for example, is introduced, and a pipe structure through which the liquid is guided to take up the thermal energy of the flue gas. In a further example embodiment, the heat exchanger device additionally has an electrical heating unit. In one example embodiment, the heat exchanger device also has inlets and outlets for the room air to be heated.

One example embodiment provides that the tank has at least one lateral wall and a transverse axis, that the introducing device has a free end located in the interior space of the tank, that the free end of the introducing device is directed towards the lateral wall of the tank, that the internal distributor has an open side, that the open side of the internal distributor is directed towards the lateral wall, and that along the transverse axis, the open side of the internal distributor is located further away from the lateral wall than the free end of the introducing device. In this example embodiment, the liquid flows out of a free end of the introducing device which is directed towards a lateral wall and thus also towards an inner wall of the tank. Starting from the lateral wall, the internal distributor is arranged behind the free end. Therefore, the internal distributor is located further towards a center of the tank than the free end. The internal distributor has an open side via which liquid can enter the interior space of the internal distributor. The open side also faces the lateral wall. The free end and the open side are arranged one behind the other along a transverse axis of the tank. In one example embodiment, they are arranged concentrically with respect to each other. In an alternative example embodiment, the free end is arranged eccentrically, but is still located in a projection of the open side.

In a supplementary example embodiment, the liquid exits the free end of the introducing device in the opposite direction to the force of gravity. Therefore, the liquid then flows downwards and thus via the open side into the internal distributor which is arranged lower than the free end.

In one example embodiment, the surface area of the free end is in particular smaller than the surface area of the open side. The edge of the free end is thus located within the open side. If the liquid follows the force of gravity after leaving the free end, if flows into the internal distributor.

One example embodiment consists in that a withdrawal device is present in the tank, that the liquid flows to the medium outlet via the withdrawal device, and that a free end of the withdrawal device is connected to an interior space of the internal distributor so that liquid from the interior space of the internal distributor flows into the withdrawal device. In this example embodiment, the liquid flows from an area of the interior space of the tank via a withdrawal device to the medium outlet. It is then provided that the withdrawal device is connected to the interior space of the internal distributor and draws liquid therefrom. The liquid is thus indirectly taken from the tank by being directly discharged from the internal distributor. If the liquid enters the larger interior space of the tank via the internal distributor and is therefore in contact only with a smaller and thus also warmer amount of liquid, the advantage is achieved during operation of the device that the liquid taken from the internal distributor is warmer than the remaining liquid in the interior space of the heat distributing device. In one example embodiment, the inflow and outflow quantities are adapted to each other such that the withdrawal device substantially directly takes up the supplied liquid. Therefore, the liquid virtually flows through the tank without mixing with the liquid present in the tank.

One example embodiment provides that a liquid passage is present between the free end of the withdrawal device and the internal distributor, via which the liquid from the withdrawal device and/or the internal distributor enters the interior space of the tank. In this example embodiment, the transition between the withdrawal device and the internal distribution is therefore not completely closed so that liquid can escape. This provides protection against the risk of frost.

The following example embodiment takes into consideration that introduced liquid can spread at the inner wall of the tank and therefore possibly not enter the internal distributor.

One example embodiment consists in that a deflecting device is present in the tank, that the free end of the introducing device is directed towards an interior space of the deflecting device, and that an inner diameter of the interior space of the deflecting device is smaller than an inner diameter of the open side of the internal distributor. In one example embodiment, the deflecting device has an edge. In one variant, the deflecting device is configured as a ring or a cover having a peripheral edge. If the deflecting device is designed in a ring shape, it is preferably arranged at the lateral wall of the tank so that this wall forms the bottom of the deflecting device.

A lateral movement of the liquid is to be restricted by the deflecting device. Due to the fact that the deflecting device has a smaller inner diameter than the internal distributor, it should be ensured that the liquid hitting the edge of the deflecting device then flows into the internal distributor. If the deflecting device were larger, the liquid would flow past the internal distributor.

One example embodiment provides that the deflecting device is arranged near to the lateral wall, and that along the transverse axis, the deflecting device is closer to the lateral wall than the free end of the introducing device. In one example embodiment, the deflecting device is located above the free end of the introducing device which is arranged above the internal distributor. In a further example embodiment, the deflecting device, the free end and the internal distributor are arranged coaxially one behind the other. In a further embodiment, the deflecting device and the free end are in a projection of the internal distributor in the direction of the lateral wall, and the free end is in a projection of the deflecting device away from the lateral wall. In this example embodiment, the surfaces of the three components which are respectively relevant to the liquid thus overlap so that the liquid is respectively guided from the free end to the deflecting device, and from the deflecting device to the internal distributor. In one example embodiment, the deflecting device is located above the free end of the introducing device against the gravitational field of the earth.

One example embodiment consists in that the free end of the introducing device is arranged substantially in a central area along a longitudinal axis of the tank. In this example embodiment, the liquid is introduced in a central area of the tank. As a result, a slightly inclined position of the tank hardly changes the interaction between the components involved.

One example embodiment provides that the tank has at least one secondary medium outlet, that a supply device is present in the tank, that the supply device introduces liquid entering the tank via the secondary medium inlet into the interior space of the tank, that the supply device has a free end located in the interior space of the tank, and that the free end of the supply device is directed towards the lateral wall of the tank. In this example embodiment, liquid enters the tank via an additional and thus second medium inlet. This is realized via a supply device, the free end of which is directed towards a lateral wall of the tank. In one example embodiment, the free end of the supply device is directed to a lowest position of the tank. In one example embodiment, this is accompanied by the collection of liquid supplied via the supply device in a lowermost layer.

One example embodiment consists in that the free end of the supply device and the free end of the introducing device point in different directions. In one example embodiment, one free end is directed upwards and the other end is directed downwards with respect to a transverse axis of the tank. In one example embodiment, the transverse axis extends substantially in the direction of the force of gravity. Therefore, preferably warm liquid is introduced in the direction of a ceiling, and cold liquid is introduced in the direction of a bottom of the tank. In one example embodiment, the ceiling and the bottom are an upper and lower portion of the lateral wall of the tank, respectively, when the latter is laid on its side during use.

One example embodiment provides that the tank further has a front side, and that the medium inlet and/or the medium outlet and/or the secondary medium inlet are arranged on the front side. In one example embodiment, three openings are located in a front side of the container from which the introducing device, the withdrawal device, and the supply device extend into the interior space.

One example embodiment consists in that the tank further includes a front side, and that the free end of the supply device is arranged closer to the front side than the free end of the introducing device. In this example embodiment, the liquid is introduced by the introducing device further into a central portion of the tank than the liquid of the supply device.

One example embodiment provides that the heat exchanger device transfers the thermal energy generated by the energy unit to the liquid and room air, that the device includes a room air inlet, a room air outlet, and a fan, and that the fan conveys room air from the room air inlet through the heat exchanger device to the room air outlet. In this example embodiment, the device serves to heat room air and liquid. The room air is therefore guided through the device and thus also past the heat exchanger device by a fan, and is thus heated.

One example embodiment consists in that the tank has an elongated shape. The longitudinal axis is significantly longer than a transverse axis. In one example embodiment, the tank is arranged—for example in a housing—such that the transverse axis extends along the force of gravity. The tank preferably has a lateral wall which extends about the longitudinal axis, and two front sides from which the lateral extends or onto which it opens.

An alternative or additional example embodiment consists in that the introducing device is substantially tubular or hose-shaped. An alternative or additional example embodiment consists in that the withdrawal device is substantially tubular or hose-shaped. An alternative or additional example embodiment consists in that the supply device is substantially tubular or hose-shaped. Depending on the embodiment, the liquid is thus guided via tubular or hose-shaped structures in the interior space of the tank. The free ends are arranged in the interior space, and the other ends are connected to the appropriate openings, for example the liquid inlet, the liquid outlet or the secondary medium inlet.

An alternative or additional example embodiment consists in that the internal distributor is substantially pot-shaped. In an exemplary embodiment, the pot is circular cylindrical.

An alternative or additional example embodiment consists in that the deflecting device is substantially ring-shaped or pot-shaped. A circular cylindrical shape is provided in one example embodiment. If the deflecting device does not have its own bottom plate, it is preferably fastened to the lateral wall of the tank so that a bottom of the deflecting device is thus formed.

One example embodiment provides that the introducing device and/or the withdrawal device and/or the supply device are guided at least in sections substantially parallel to each other.

One example embodiment consists in that the liquid is service water. In this example embodiment, the individual components and the connections thereof are thus suitable for drinking water.

One example embodiment provides that the energy unit generates thermal energy by the combustion of a fuel-air-mixture and/or by the conversion of electrical energy. In this example embodiment, the thermal energy is generated by the combustion of a fuel, for example combustible gas or diesel fuel converted into the gaseous state, or by the conversion of electrical energy.

BRIEF DESCRIPTION OF DRAWINGS

More specifically, there are many possibilities for designing and further developing the device according to the invention. To this end, reference is made, on the one hand, to the claims which depend on claim 1, and, on the other hand, to the description below of example embodiments in conjunction with the drawing, in which:

DETAILED DESCRIPTION

Figure 1:
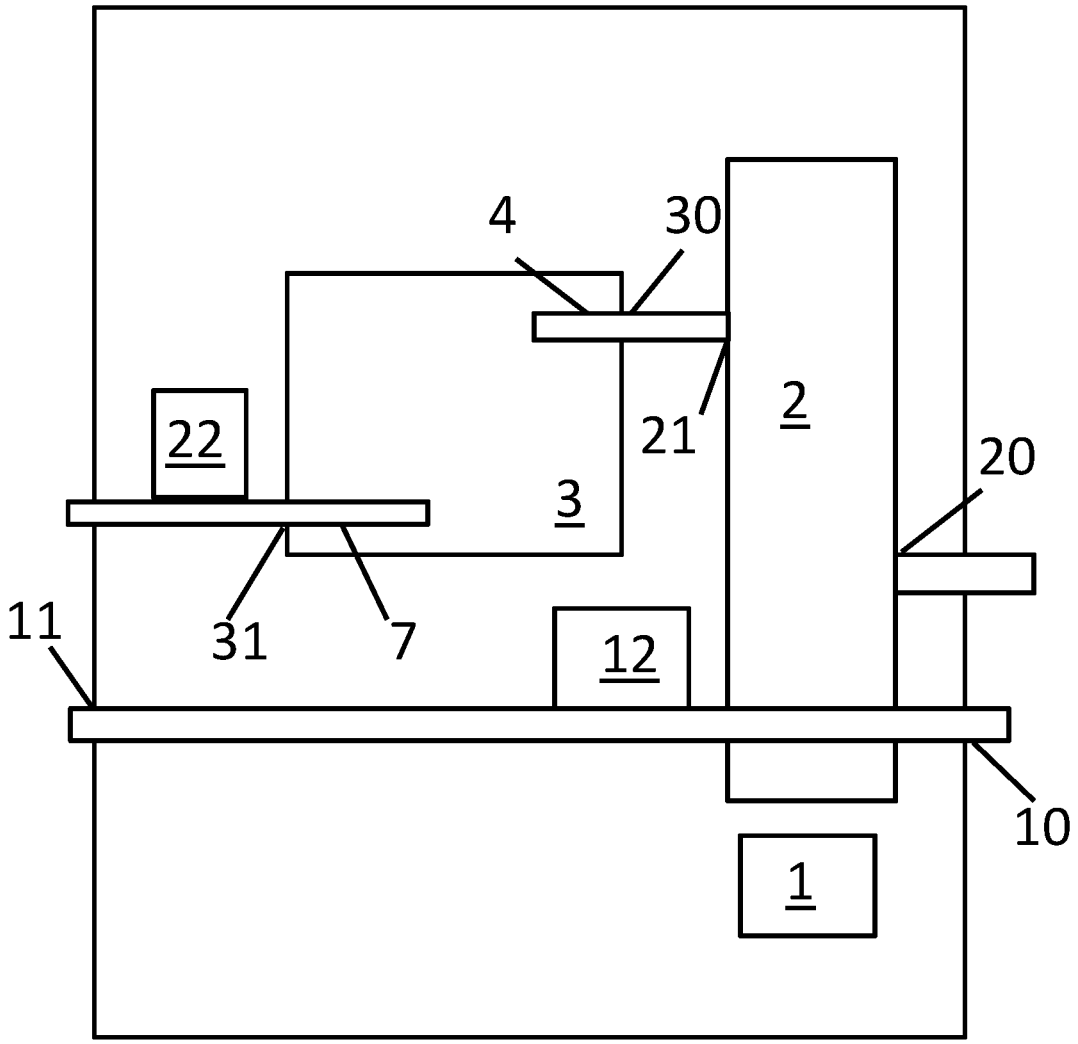
FIG. 1 shows a schematic representation of a device according to a first variant.

FIG. 1 schematically shows the structure of a device for heating a liquid and the room air. In the variant shown, the thermal energy for heating is generated by the energy unit 1 by the combustion of a fuel-air mixture and is transferred to the liquid and the room air by the heat exchanger device 2. The room air is moved by a fan 12 from the room air inlet 10 through the heat exchanger device 2 to the room air outlet 11. The liquid enters the liquid inlet 20 of the heat exchanger device 2 to be heated there. The liquid then leaves the heat exchanger device 2 via the liquid outlet 21 and enters the tank 3 via the medium inlet 30. The heated liquid is introduced further into the interior space by the introducing device 4. The liquid is removed from the tank 3 by a pumping device 22. The liquid flows to the medium outlet 31 via the withdrawal device 7 and leaves the device. In an alternative embodiment—not shown here—the pumping device is arranged upwards and conveys cold water. In the embodiment shown, the medium inlet 30 and the medium outlet 31 are arranged on different front sides of the tank.

Figure 2:
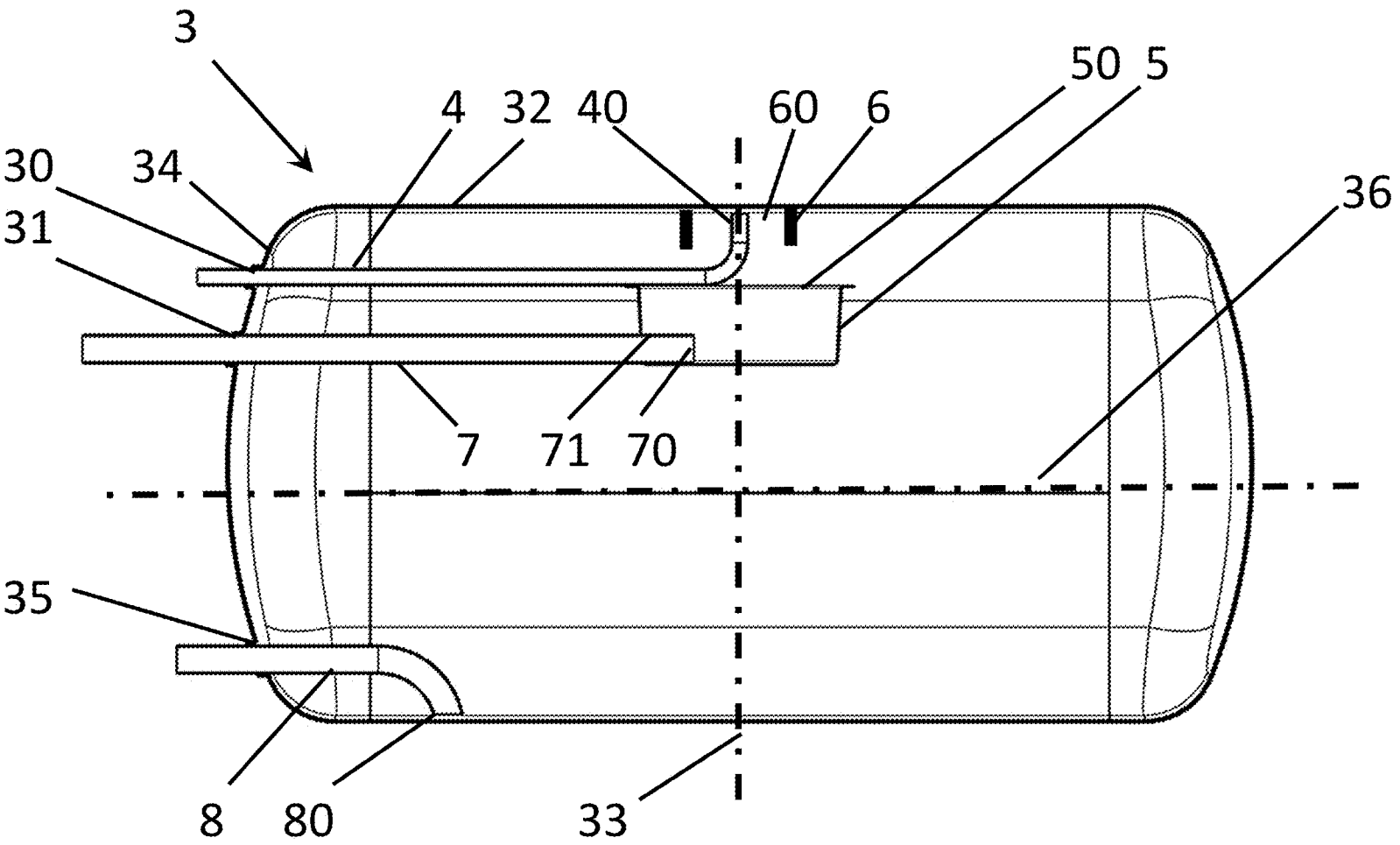
FIG. 2 shows a schematic representation of the tank as a part of the device according to a second variant.

In the detailed representation of a different embodiment of the tank 3 of FIG. 2, the medium inlet 30 and the medium outlet 31 are arranged on the same front side 34. The tank 3 has here a substantially elongated basic shape adjoined by two front sides. The tank 3 is oriented such that the transverse axis 33 extends in the direction of the gravitational field or the force of gravity.

The heated liquid is introduced into the interior space of the tank 3 from the medium inlet 30 via the introducing device 4. The free end 40 of the introducing device 4 is directed towards a lateral wall—here the long side—of the tank 3. In the embodiment shown, the liquid is thus discharged upwards and then flows downwards. The substantially straight and tubular introducing device 4 has an upwardly extending bend in front of the free end 40 thereof.

To prevent the liquid from spreading too far along the lateral wall 32, a cover-shaped deflecting device 6 is here present on the lateral wall 32. The edge thereof prevents the liquid from propagating laterally out of the interior space 60 before it flows downwards due to the force of gravity. It can be seen that the inner diameter of the interior space 60 of the deflecting device 6 is smaller than the inner diameter of the open side 50 of the internal distributor 5. In the embodiment shown, the deflecting device 6 and the internal distributor 5 are for example circular-cylindrical in shape. Due to the inner diameters which are adapted to each other, substantially the entire liquid from the introducing device 4 enters the interior space of the internal distributor 5.

The liquid then flows directly out of the open side 50 of the internal distributor 5 into the interior space of the tank 3.

The heated liquid thus first flows from the introducing device 4 into the deflecting device 6 and therefore indirectly into the interior space of the tank 3 such that a kind of focusing of the liquid jet is produced. From here, the liquid enters the interior space of the internal distributor 5 and thus again indirectly the interior space of the tank 3. When the internal distributor 5 is sufficiently filled or when the liquid has sufficient kinetic energy, the liquid flows from the internal distributor 5 directly into the interior space of the tank 3.

At least two advantages are achieved with the internal distributor 5: less liquid with which the newly introduced liquid mixes is present in the internal distributor 5. Therefore, a smaller temperature difference or degree of cooling is to be expected due to the liquid present. Furthermore, the kinetic energy of the newly introduced liquid is reduced. This reduces the risk of different layers of liquid combining with each other or the newly introduced and just heated liquid reaching a cold layer of liquid.

The liquid is removed from the tank 3 via the—straight, tubular—withdrawal device 7 and the medium outlet 31. The free end 70 of the withdrawal device 7 is connected to the interior space of the internal distributor 5. The liquid thus indirectly flows out of the interior space of the tank 3 by being removed from a partial space—namely the interior space of the internal distributor 5. A gap or a slit which serves as a liquid passage 71 is then present between the internal distributor 5 and the—here substantially tubular—withdrawal device 7. Therefore, liquid can escape, and the risk of frost damage is counteracted.

All in all, it can be seen that the deflecting device 6, the free end 40 of the introducing device 4, and the internal distributor 5 are arranged coaxially relative to each other along the transverse axis 33. Therefore, the liquid is in particular introduced into a central area of the interior space of the tank 3 and withdrawn from there.

Along the longitudinal axis 36, the supply device 8—which is also substantially tubular here—has its open end 80 opening so as to be arranged upstream of the central area of the tank 3. The supply device 8 thus also opens upstream of the introducing device 4. The free end 80, after a bend of the supply device 8, is here directed towards the lateral wall 32 and, in the embodiment shown, introduces cold liquid from the secondary medium inlet 35 into the tank 3. Due to the orientation of the tank 3, a low cold liquid layer is therefore produced. The secondary medium inlet 35 is also located on the front side 34 which already has the medium inlet 30 and the medium outlet 31.

It can be seen that the bends of the introducing device 4 and the supply device 8 are oriented such that the associated free ends 40, 80 are directed towards an inner walls opposite each other. This applies to the case of application shown here, in which the tank lies on its longitudinal side.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

LIST OF REFERENCE NUMERALS

1 energy unit
2 heat exchanger device
3 tank
4 introducing device
5 internal distributor
6 deflecting device
7 withdrawal device
8 supply device
10 room air inlet
11 room air outlet
12 fan
20 liquid inlet
21 liquid outlet
22 pumping device
30 medium inlet
31 medium outlet
32 lateral wall
33 transverse axis
34 front side
35 secondary medium inlet
36 longitudinal axis
40 free end of the introducing device
50 open side of the internal distributor
60 interior space of the deflecting device
70 free end of the withdrawal device
71 liquid passage
80 free end of the supply device

The invention claimed is:

1. A device for heating a liquid, comprising:
an energy unit, a heat exchanger device, and a tank,
wherein the energy unit generates thermal energy,
wherein the heat exchanger device transfers the thermal energy generated by the energy unit to the liquid,
wherein the tank takes up the liquid,
wherein the tank has at least one medium inlet and one medium outlet,
wherein at least one introducing device and an internal distributor are present in the tank,
wherein the at least one introducing device introduces liquid entering the tank via the medium inlet into an interior space of the tank,
wherein the at least one introducing device and the internal distributor are configured and arranged relative to each other such that liquid flows from the at least one introducing device into an interior space of the internal distributor and from the interior space of the internal distributor into the interior space of the tank,
wherein the tank has at least one lateral wall and a transverse axis,
wherein the at least one introducing device has a free end located in the interior space of the tank,
wherein the free end of the at least one introducing device is directed towards the at least one lateral wall of the tank,
wherein the internal distributor has an open side,
wherein the open side of the internal distributor is directed towards the lateral wall,
wherein along the transverse axis, the open side of the internal distributor is located further away from the at least one lateral wall than the free end of the at least one introducing device,
wherein a deflecting device is present in the tank,
wherein the free end of the at least one introducing device is directed towards an interior space of the deflecting device, and
wherein an inner diameter of the interior space of the deflecting device is smaller than an inner diameter of the open side of the internal distributor.

2. The device according to claim 1, wherein the deflecting device is arranged near the lateral wall, and wherein along the transverse axis, the deflecting device is located closer to the lateral wall-than the free end of the at least one introducing device.

3. The device according to claim 1, wherein a withdrawal device is present in the tank, wherein the liquid flows to the medium outlet via the withdrawal device, and wherein a free end of the withdrawal device is connected to an interior space of the internal distributor so that liquid from the interior space of the internal distributor enters the withdrawal device.

4. The device according to claim 3, wherein a liquid passage is present between the free end of the withdrawal device and the internal distributor, via which the liquid flows from the withdrawal device and/or the internal distributor into the interior space of the tank.

5. The device according to claim 1, wherein the tank has at least one secondary medium inlet, wherein a supply device is present in the tank, wherein the supply device introduces liquid entering the tank via the at least one secondary medium inlet into the interior space of the tank, wherein the supply device has a free end located in the interior space of the tank, and wherein the free end of the supply device is directed towards the lateral wall of the tank.

6. A device for heating a liquid, comprising:

an energy unit, a heat exchanger device, and a tank, wherein the energy unit generates thermal energy, wherein the heat exchanger device transfers the thermal energy generated by the energy unit to the liquid, wherein the tank takes up the liquid, wherein the tank has at least one medium inlet and one medium outlet, wherein at least one introducing device and an internal distributor are present in the tank, wherein the at least one introducing device introduces liquid entering the tank via the medium inlet into an interior space of the tank, wherein the at least one introducing device and the internal distributor are configured and arranged relative to each other such that liquid flows from the at least one introducing device into an interior space of the internal distributor and from the interior space of the internal distributor into the interior space of the tank, wherein the tank has at least one secondary medium inlet, wherein a supply device is present in the tank, wherein the supply device introduces liquid entering the tank via the at least one secondary medium inlet into the interior space of the tank, wherein the supply device has a free end located in the interior space of the tank, and wherein the free end of the supply device is directed towards the lateral wall of the tank.

* * * * *